US007926134B2

(12) United States Patent
Carlos

(10) Patent No.: US 7,926,134 B2
(45) Date of Patent: Apr. 19, 2011

(54) SPINAL SUPPORTING SLEEP PILLOW

(76) Inventor: Victor Ramon Carlos, Huntington Beach, CA (US)

( * ) Notice: Subject to any disclaimer, the term of this patent is extended or adjusted under 35 U.S.C. 154(b) by 1138 days.

(21) Appl. No.: 11/289,031

(22) Filed: Nov. 29, 2005

(65) Prior Publication Data

US 2007/0118992 A1 May 31, 2007

(51) Int. Cl.
*A47G 9/00* (2006.01)
*A47G 9/10* (2006.01)

(52) U.S. Cl. ..... 5/645; 5/640

(58) Field of Classification Search ..... 5/630, 632, 5/633, 640, 644, 645, 652, 657
See application file for complete search history.

(56) References Cited

U.S. PATENT DOCUMENTS

| | | | | |
|---|---|---|---|---|
| 211,741 | A * | 1/1879 | Eremita et al. | 5/630 |
| 3,061,844 | A * | 11/1962 | Coursey | 5/640 |
| 3,849,810 | A * | 11/1974 | Degen | 5/640 |
| 4,494,261 | A * | 1/1985 | Morrow | 5/636 |
| 4,617,691 | A | 10/1986 | Monti et al. | |
| 4,850,067 | A * | 7/1989 | Latorre | 5/636 |
| 5,163,194 | A | 11/1992 | Dixon | |
| 5,214,814 | A * | 6/1993 | Eremita et al. | 5/636 |
| 5,479,667 | A * | 1/1996 | Nelson et al. | 5/636 |
| 5,632,050 | A * | 5/1997 | Zajas et al. | 5/632 |
| 5,727,267 | A * | 3/1998 | Keilhauer | 5/636 |
| 5,772,686 | A * | 6/1998 | Caruana | 606/240 |
| 5,829,079 | A * | 11/1998 | Castro | 5/636 |
| 5,987,675 | A * | 11/1999 | Kim | 5/632 |
| 6,226,817 | B1 | 5/2001 | Rubio | |
| 6,292,964 | B1 | 9/2001 | Rose et al. | |
| 6,471,726 | B2 * | 10/2002 | Wang | 5/636 |
| 6,671,906 | B1 * | 1/2004 | Milligan | 5/636 |
| 6,789,281 | B2 * | 9/2004 | Wilson | 5/632 |
| 6,817,049 | B1 * | 11/2004 | Hall | 5/636 |
| 2004/0068799 | A1 * | 4/2004 | Wilson | 5/632 |
| 2006/0123547 | A1 * | 6/2006 | Ferber et al. | 5/636 |
| 2006/0253986 | A1 * | 11/2006 | Rubio | 5/632 |
| 2007/0067915 | A1 * | 3/2007 | Pryor | 5/636 |

FOREIGN PATENT DOCUMENTS

| | | |
|---|---|---|
| CA | 2224630 | 9/1999 |

OTHER PUBLICATIONS

Adjacent. (n.d.). The American Heritage® Dictionary of the English Language, Fourth Edition. Retrieved Jul. 10, 2008, from Dictionary.com website: http://dictionary.reference.com/browse/adjacent.*

* cited by examiner

*Primary Examiner* — Shane Bomar
*Assistant Examiner* — Gilbert Y Lee
(74) *Attorney, Agent, or Firm* — Joshua C. Harrison; Barcelo, Harrison & Walker LLP

(57) ABSTRACT

A pillow includes a flexible outer shell including a plurality of internal dividers that define a plurality of compartments. Stuffing material is within each of the plurality of compartments. The pillow has a tapered center region defining a center region longitudinal axis and a top region defining a top region longitudinal axis that is approximately orthogonal to the center region longitudinal axis. The top region has a left portion, a center portion, and a right portion. The tapered center region has a thicker end that is adjacent the center portion of the top region, and a thinner distal end. At least one of internal dividers is located within the tapered center region and is oriented approximately orthogonal to the center region longitudinal axis. At least one of the plurality of internal dividers is located within the top region and is oriented approximately orthogonal to the top region longitudinal axis.

21 Claims, 6 Drawing Sheets

SPINAL SUPPORTING SLEEP PILLOW

TECHNICAL FIELD

The present disclosure relates generally to pillow design and manufacture, and more specifically to the design and manufacture of pillows for human spine and head support during sleep.

BACKGROUND

Physical therapists and other physicians commonly shape pillows for therapeutic purposes, typically from blocks of foam. However their patients rarely find the pillows to give satisfactory comfort for long-term use as a sleeping pillow, or to provide the right mix of thoracic and cervical support and cranial support in various sleeping positions. For example, such pillows typically do not allow for the stiffness or softness experienced by the user to be varied in different regions to enhance comfort or support of different body surfaces in different sleeping positions. Moreover, such pillows are typically fabricated from materials that are excessively dissimilar from the sleeping pillow materials to which people have grown accustomed.

Therefore, there is an unmet need in the art for an improved human spine and head supporting sleep pillow.

SUMMARY

A pillow includes a flexible outer shell including a plurality of internal dividers that define a plurality of compartments. Stuffing material is within each of the plurality of compartments. The pillow has a tapered center region defining a center region longitudinal axis and a top region defining a top region longitudinal axis that is approximately orthogonal to the center region longitudinal axis. The top region has a left portion, a center portion, and a right portion. The tapered center region has a thicker end that is adjacent the center portion of the top region, and a thinner distal end. At least one of internal dividers is located within the tapered center region and is oriented approximately orthogonal to the center region longitudinal axis. At least one of the plurality of internal dividers is located within the top region and is oriented approximately orthogonal to the top region longitudinal axis.

DETAILED DESCRIPTION OF THE DISCLOSED EXEMPLARY EMBODIMENTS

Figure 1:
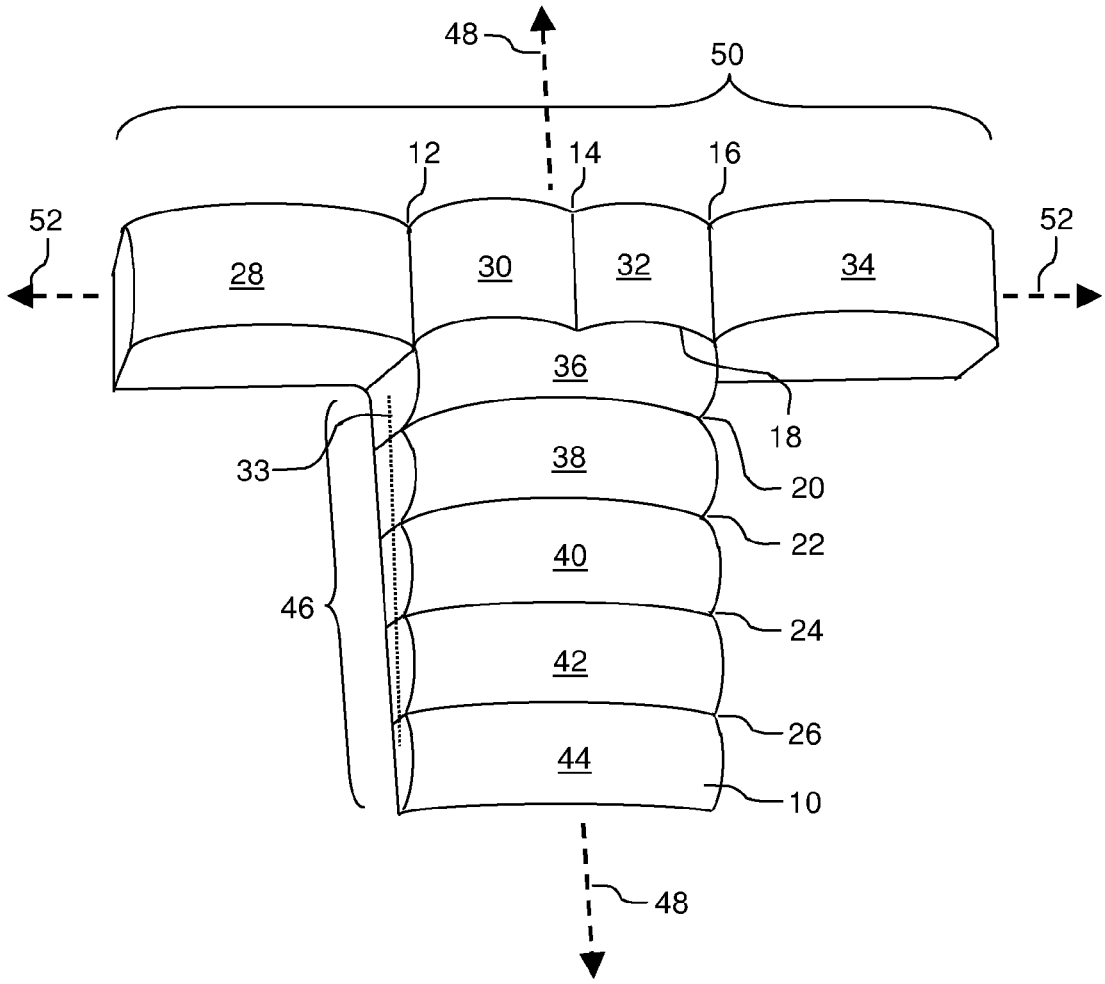
FIG. 1 is a perspective view of a pillow according to an exemplary embodiment of the present invention.

FIG. 1 is a perspective view of a pillow according to an exemplary embodiment of the present invention. The pillow of FIG. 1 includes a flexible outer shell 10 that includes a plurality of internal dividers 12, 14, 16, 18, 20, 22, 24, 26, the edges of which are visible in this view. The flexible outer shell 10 may include cloth fabric or leather or any other material customarily used in the flexible outer shells of sleeping pillows. The internal dividers 12, 14, 16, 18, 20, 22, 24, and 26 define a plurality of compartments 28, 30, 32, 34, 36, 38, 40, 42, and 44. Stuffing material is within each of the plurality of compartments 28, 30, 32, 34, 36, 38, 40, 42, 44. The stuffing material may include feathers or synthetic fibers or any other material customarily used in sleeping pillows.

The pillow of FIG. 1 has a tapered center region 46 that, in this embodiment, includes compartments 36, 38, 40, 42, and 44. The tapered center region 46 defines a center region longitudinal axis 48. In certain embodiments, the tapered center region 46 preferably extends along the center region longitudinal axis sufficiently to support the user's thoracic spine down to the inferior aspect of the pillow user's scapulae. In such embodiments, the length of the tapered center region 46 is preferably in the range 20 cm to 40 cm. In certain embodiments, the width of the tapered center region 46 is preferably sufficient to support both of the user's shoulders in the supine position. In such embodiments, the width of the tapered region 46 is preferably in the range 30 cm to 53 cm. The pillow of FIG. 1 also has a top region 50 that, in this embodiment, includes compartments 28, 30, 32, and 34. The top region 50 defines a top region longitudinal axis 52 that is approximately orthogonal to the center region longitudinal axis 48. For example, the angle between the top region longitudinal axis 52 and the center region longitudinal axis 48 is preferably in the range 70° to 110°. The top region 50 has a left portion that, in this embodiment, comprises compartment 28. The top region has a center portion that, in this embodiment, comprises compartments 30 and 32. The top region also has a right portion that, in this embodiment, comprises compartment 34. Each of the left and right portions extends away from the center portion, along the top region longitudinal axis 52, by a left or right extension distance preferably in the range 30 cm to 46 cm. In certain embodiments, each of the left and right portions has a breadth, measured parallel to the center region longitudinal axis 48, that is preferably in the range 25 cm to 46 cm.

In the embodiment of FIG. 1, internal dividers 20, 22, 24, and 26 are located within the tapered center region 46 and are oriented approximately orthogonal to the center region longitudinal axis 48. For example, the angle between internal divider 20 and the center region longitudinal axis 48 is preferably in the range 70° to 110°, and that is preferably true also for internal dividers 22, 24, and 26. In the embodiment of FIG. 1, internal dividers 12, 14, and 16 are located within the top region 50 and are oriented approximately orthogonal to the top region longitudinal axis 52. For example, the angle between internal divider 14 and the top region longitudinal axis 52 is preferably in the range 70° to 110°, and that is preferably true also for internal dividers 12 and 16. In the embodiment of FIG. 1, internal divider 14 fully bisects the top region 50 and is approximately aligned with the center region longitudinal axis 48. For example, the angle between internal divider 14 and the center region longitudinal axis 48 is preferably less than 10°. The approximate alignment of the crease caused by internal divider 14 and the center region longitudinal axis 48 helps prevent rolling of the pillow user's head when lying in the supine position, thereby enhancing support and comfort.

Figure 2A:
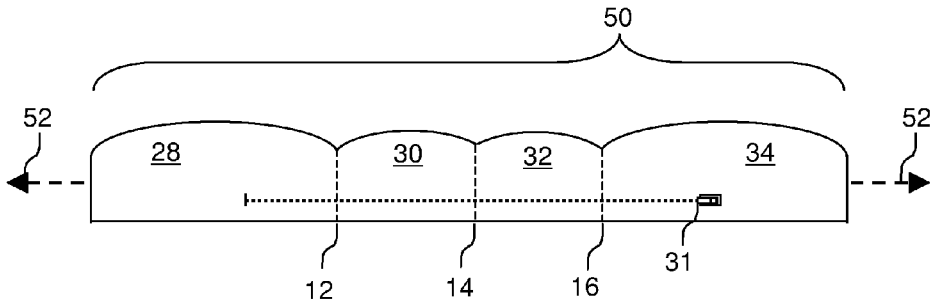
FIGS. 2A and 2B depict a top view and a cross-section of a pillow along a top region longitudinal axis, respectively, according to an exemplary embodiment of the present invention.

As shown in FIGS. 1 & 2A, the stuffing material may be inserted and/or wholly or partially removed via one or more conventional zippered openings. Preferably, stuffing would be inserted into or removed from compartments 28, 30, 32, and 34, via a first conventional zippered opening 31 running approximately parallel to the top region longitudinal axis 52 and being long enough to substantially cross internal dividers 12, 14, and 16. Preferably, stuffing would be inserted into or removed from compartments 36, 38, 40, 42, and 44, via a second conventional zippered opening 33 running approximately parallel to the center region longitudinal axis 48 and being long enough to substantially cross internal dividers 20, 22, 24, and 26. However, more numerous and/or non-zippered openings could be used. For example, a separate opening might be used for each compartment, and/or one or more of the openings might be opened and closed by conventional Velcro strips rather than by a conventional metal or plastic zipper.

In certain embodiments of the present invention, a firmness of the stuffing material in the center portion of the top region 50 is less than a firmness of the stuffing material in the left and right portions. The desired stiffness difference may be obtained by selecting a different conventional stuffing material for use in the compartments of the center portion of the top region relative to other compartments. Optionally, the desired stiffness difference may also be obtained by inserting more stuffing material per unit volume in compartments 28 and 34 than in compartments 30 and 32. In that case, the thickness of the center portion of the top region 50 may be less than the thickness of the right portion and less than the thickness of the left portion.

Figure 2B:
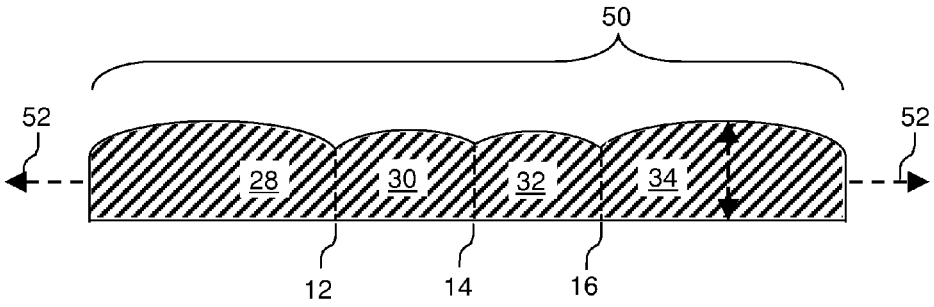

Such a relative thickness difference is depicted in FIG. 2B, which depicts a cross-section of a pillow according to an exemplary embodiment of the present invention, taken along a top region longitudinal axis 52. The direction of measurement of pillow thickness at various locations, for the purposes of this disclosure, is shown by way of example in compartment 34 of the right portion of the top region 50 by double-headed arrow 54. Following this convention, the thickness of the center portion of the top region 50, at the location of internal divider 14, is preferably in the in the range 10 cm to 23 cm. Also, it can be seen from FIG. 2B that, in this particular embodiment, the thickness of the pillow everywhere in the center portion of the top region 50 is less than the max thickness of the right portion (near the middle of compartment 34) and less than the max thickness of the left portion (near the middle of compartment 28). Such a relative thickness difference enhances support of the pillow user's head while lying on his/her side, while providing adequate support for the pillow user's cervical spine while lying in a supine position. Without such support, the pillow user has an increased chance of developing pathological conditions such as decreased cervical lordosis, facet joint syndrome, spastic cervical muscles, torticolis, and headaches stemming from decreased range of motion.

Figure 3:
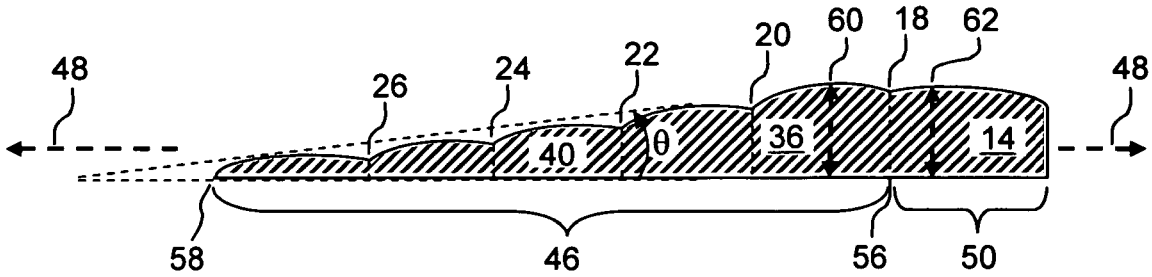
FIG. 3 depicts a possible cross-section of a pillow according to an exemplary embodiment of the present invention, along a center region longitudinal axis.

FIG. 3 depicts a cross-section of a pillow according to an exemplary embodiment of the present invention, taken along a center region longitudinal axis 48. The tapered center region 46 has a thicker end 56 that is adjacent the center portion of the top region, and a thinner distal end 58. In the embodiment of FIG. 3, the tapered center region 46 defines an average taper angle θ. The average taper angle θ is preferably in the range 8° to 25°. Note that in this embodiment the thickness 60 of compartment 36 is greater than the thickness 62 of the center portion of the top region at the location of internal divider 14. Such a difference in thickness allows compartment 36 to render enhanced cervical support for the user of the pillow when the user is in the supine position, while the center portion of the top region provides cranial support at a location of lesser relative thickness. In certain embodiments, however, the local taper angle defined by the high points of sections 38 and 36 is designed to be at least 30°. In such embodiments, the pillow user's risk of sleep apnea may be reduced.

Figure 4:
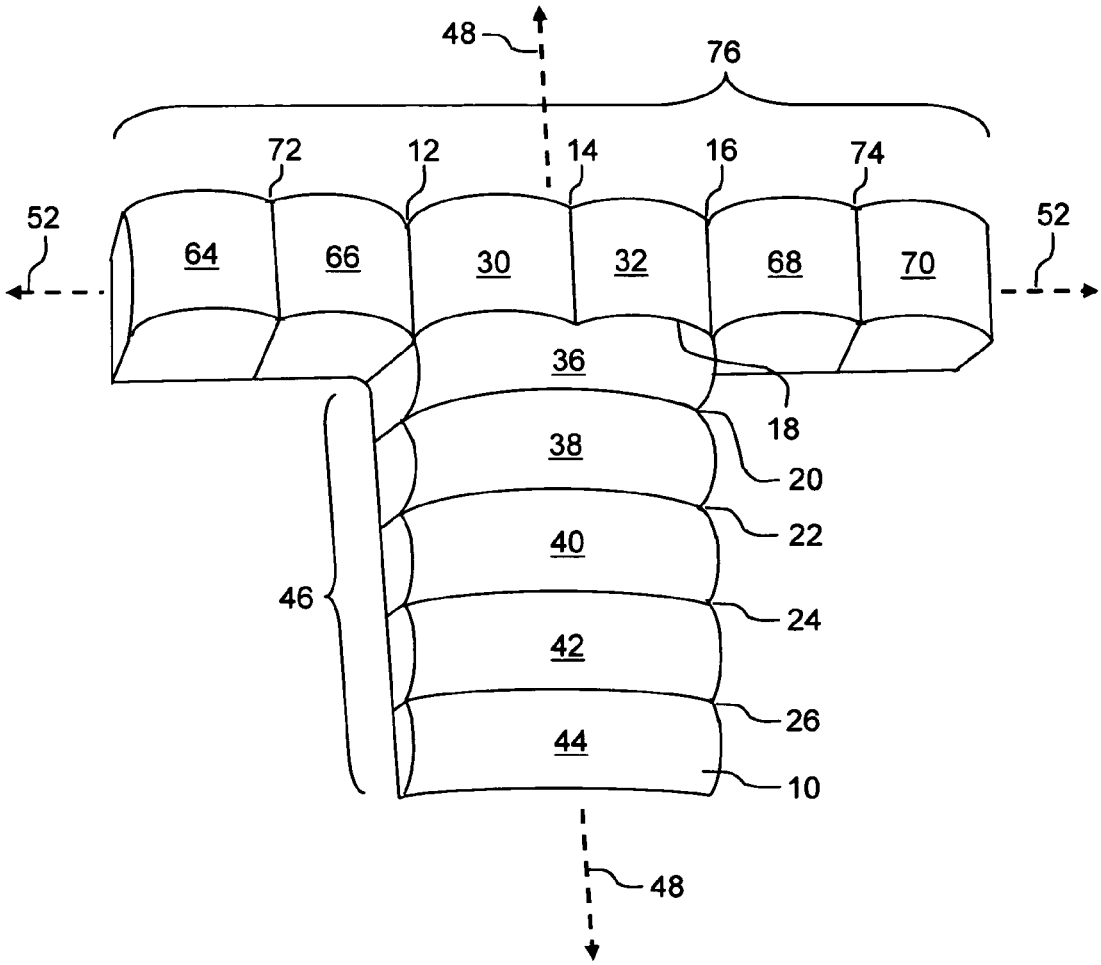
FIG. 4 is a perspective view of a pillow according to another exemplary embodiment of the present invention.

FIG. 4 is a perspective view of a pillow according to another exemplary embodiment of the present invention. The pillow is of similar construction to that depicted in FIG. 1, except that the left portion of the top region 76 includes compartments 64 and 66, and internal divider 72, and the right portion of the top region 76 includes compartments 68 and 70, and internal divider 74. Certain embodiments of the present invention, including but not limited to the embodiment of FIG. 4, may be used in skilled nursing applications to reduce the need for multiple pillows to relieve pressure on body prominences.

Figure 5:
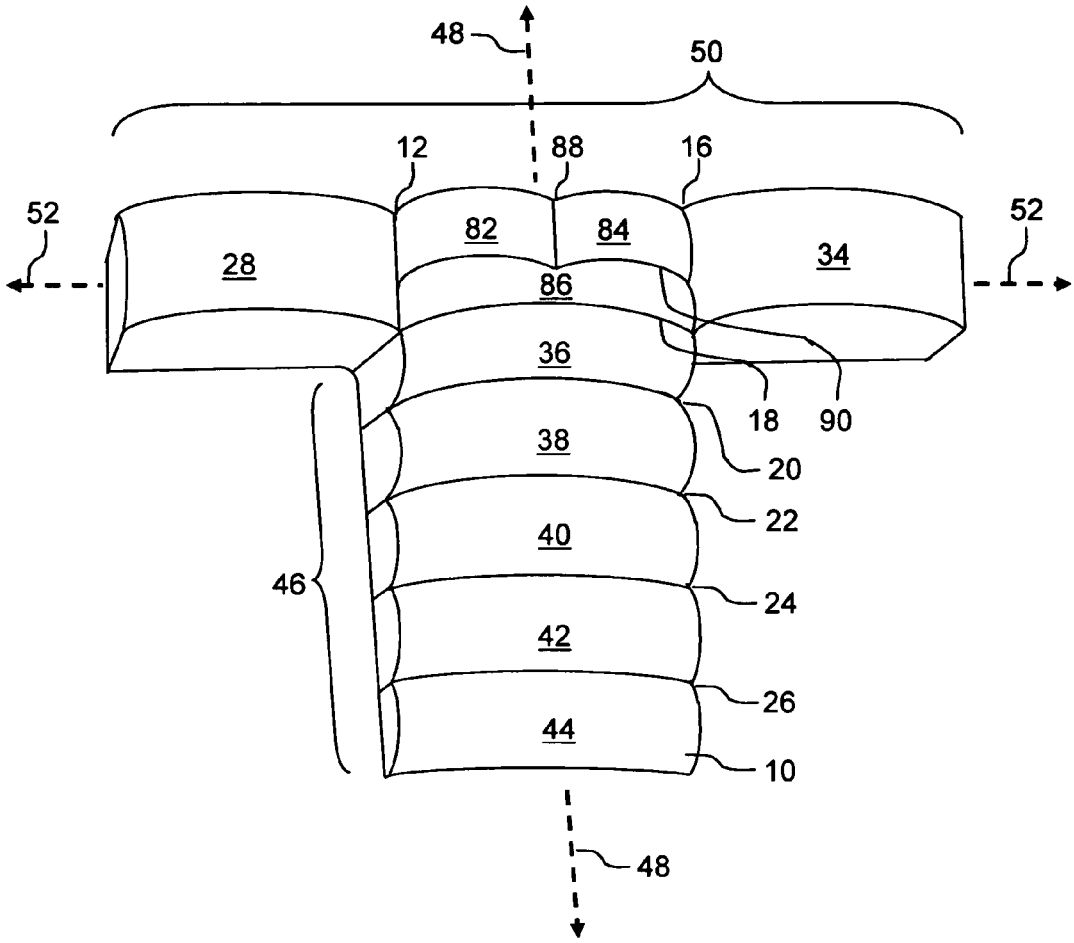
FIG. 5 is a perspective view of a pillow according to another exemplary embodiment of the present invention.

FIG. 5 is a perspective view of a pillow according to another exemplary embodiment of the present invention. The pillow of FIG. 5 is of similar construction to that depicted in FIG. 1, except that the center portion of the top region 80 includes compartments 82, 84, and 86, and internal dividers 88 and 90, and compartment 86 is designed to provide cervical support rather than compartment 36. Internal divider 88 is approximately aligned with the center region longitudinal axis 48, but only partially bisects the top region in the embodiment of FIG. 5. For example, the angle between internal divider 88 and the center region longitudinal axis 48 is preferably less than 10°.

Figure 6:
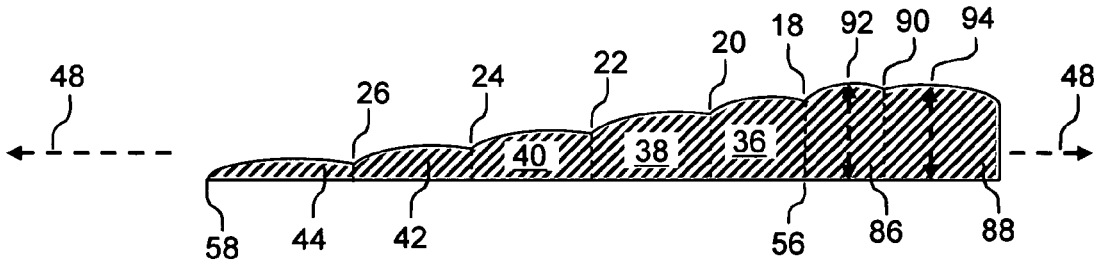
FIG. 6 depicts a cross-section of a pillow according to an exemplary embodiment of the present invention, along a center region longitudinal axis.

FIG. 6 depicts a cross-section of a pillow according to an embodiment of the present invention, taken along a center region longitudinal axis. In the embodiments of FIGS. 5 and 6, the center portion of the top region 80 includes an area of increased thickness 92 in compartment 86 which is adjacent the thicker end 56 of the tapered center region 46. The center portion of the top region 80 also includes an area of reduced thickness 94 (along internal divider 88) that is further from the thicker end 56 of the tapered center region 46 than is the area of increased thickness 92 in compartment 86. In the embodiment of FIGS. 5 and 6, the thickness of compartment 36 is less important for the purpose of cervical support since cervical support is primarily provided by compartment 86, but the increased thickness 92 in compartment 86 is preferably at least 5% thicker than reduced thickness 94 along internal divider 88.

In certain embodiments, increased thickness 92 is preferably in the range 18 cm to 30 cm. In certain embodiments, the thickness of the pillow in the left and right portions preferably reaches a maximum in the range 12 cm to 25 cm. In certain embodiments, the thickness of the pillow in compartment 36 preferably reaches a maximum in the range 10 cm to 23 cm. In certain embodiments, the thickness of the pillow in compartment 44 preferably reaches a maximum in the range 0.5 cm to 2.5 cm.

One of ordinary skill in the art will recognize that the present invention is not limited to the subset of exemplary embodiments described in the preceding paragraphs. Rather, the scope of patent coverage is governed by the following claims. Note that many words herein (e.g. "comprising," "including," "having," etc.) are intended to have open-ended interpretations.

I claim:

1. A pillow comprising:

a flexible outer shell including a plurality of internal dividers that define a plurality of compartments;

stuffing material within each of the plurality of compartments;

the flexible outer shell further comprising a tapered center region defining a center region longitudinal axis;

a top region defining a top region longitudinal axis that is approximately orthogonal to the center region longitudinal axis, the top region including a left portion, a center portion, and a right portion;

the tapered center region including a thicker end that is adjacent the center portion of the top region, and a thinner distal end;

at least one of the plurality of internal dividers being located within the tapered center region and being oriented approximately orthogonal to the center region longitudinal axis; and at least one of the plurality of internal dividers being located within the top region and being oriented approximately orthogonal to the top region longitudinal axis.

2. The pillow of claim 1, wherein a thickness of the center portion of the top region is less than a thickness of the right portion and less than a thickness of the left portion.

3. The pillow of claim 1, wherein one of the plurality of internal dividers at least partially bisects the top region and is approximately aligned with the center region longitudinal axis.

4. The pillow of claim 3, wherein an angle between the one of the plurality of internal dividers that at least partially bisects the top region and the center region longitudinal axis is less than 10°.

5. The pillow of claim 1, wherein the center portion of the top region includes an area of increased thickness adjacent the thicker end of the tapered center region, and an area of reduced thickness, the area of increased thickness being disposed between the thicker end of the tapered center region and the area of reduced thickness.

6. The pillow of claim 5, wherein a thickness of the area of increased thickness is at least 5% thicker than the area of reduced thickness.

7. The pillow of claim 6, wherein a thickness of the area of increased thickness is in the range 18 cm to 30 cm.

8. The pillow of claim 1, wherein a thickness of the center portion of the top region is in the range 10 cm to 23 cm.

9. The pillow of claim 1, wherein the tapered center region defines an average taper angle, and the average taper angle is in the range 8° to 25°.

10. The pillow of claim 1, wherein the tapered center region defines a local taper angle that exceeds 30°.

11. The pillow of claim 1 wherein a firmness of the stuffing material in the center portion of the top region is less than a firmness of the stuffing material in the left and right portions.

12. The pillow of claim 1 wherein each of the left and right portions has a thickness in the range 12 cm to 25 cm.

13. The pillow of claim 1, wherein the outer shell further comprises at least one zipper through which at least a portion of the stuffing material can be removed from at least one of the plurality of compartments.

14. The pillow of claim 13, wherein the outer shell further comprises a plurality of zippers through which at least a portion of the stuffing material can be removed from more than one of the plurality of compartments.

15. The pillow of claim 1 wherein the flexible outer shell comprises cloth fabric.

16. The pillow of claim 1, wherein the flexible outer shell comprises leather.

17. The pillow of claim 1, wherein the stuffing material comprises feathers.

18. The pillow of claim 1, wherein the stuffing material comprises synthetic fibers.

19. The pillow of claim 1, wherein an angle between the top region longitudinal axis and the center region longitudinal axis is in the range 70° to 110°.

20. The pillow of claim 1, wherein an angle between the at least one of the plurality of internal dividers located in the tapered center region and the center region longitudinal axis is in the range 70° to 110°.

21. The pillow of claim 1, wherein an angle between the at least one of the plurality of internal dividers located in the top region and the top region longitudinal axis is in the range 70° to 110°.

* * * * *